US008810420B2

(12) United States Patent
Stanek et al.

(10) Patent No.: US 8,810,420 B2
(45) Date of Patent: Aug. 19, 2014

(54) INTEGRATED FUSE STATUS INDICATION IN AN OPEN FUSE BLOCK

(75) Inventors: Daniel F. Stanek, Chicago, IL (US); Nathan C. Siegwald, Tolono, IL (US); Thomas M. Novak, Tolono, IL (US); Christopher J. Miller, Champaign, IL (US); Daniel R. Gilman, Hinsdale, IL (US); William F. Gonzalez, Tolono, IL (US); Jesse D. Rednour, Sadorus, IL (US)

(73) Assignee: Littelfuse, Inc., Chicago, IL (US)

( * ) Notice: Subject to any disclaimer, the term of this patent is extended or adjusted under 35 U.S.C. 154(b) by 179 days.

(21) Appl. No.: 13/406,910

(22) Filed: Feb. 28, 2012

(65) Prior Publication Data

US 2012/0218113 A1 Aug. 30, 2012

Related U.S. Application Data

(60) Provisional application No. 61/447,588, filed on Feb. 28, 2011.

(51) Int. Cl.
*G08B 21/00* (2006.01)

(52) U.S. Cl.
USPC ..... 340/638; 340/640; 340/664; 340/657; 340/815.4

(58) Field of Classification Search
CPC ..... H01H 85/32; H01H 9/104; H01H 21/16; H01H 85/30; H01H 9/102; H01H 71/04; H01H 85/12; H01H 9/167; H01H 2071/088; H01H 2085/209; H01H 2085/0233; H01H 2085/2065; H01H 85/147; H01H 85/185
USPC ..... 340/638, 657, 815.4, 640, 664
See application file for complete search history.

(56) References Cited

U.S. PATENT DOCUMENTS

| | | | | |
|---|---|---|---|---|
| 5,002,505 | A * | 3/1991 | Jones et al. | 439/620.29 |
| 5,559,662 | A * | 9/1996 | Happ et al. | 361/104 |
| 6,157,287 | A * | 12/2000 | Douglass et al. | 337/198 |
| 7,385,518 | B2 * | 6/2008 | Torrez et al. | 340/638 |
| 7,772,959 | B2 * | 8/2010 | Cheng et al. | 337/242 |
| 7,855,630 | B2 * | 12/2010 | Darr | 337/206 |
| 7,892,032 | B2 * | 2/2011 | Pizzi | 439/620.33 |
| 2002/0064013 | A1 * | 5/2002 | Milanczak | 361/104 |

* cited by examiner

*Primary Examiner* — Daniel Wu
*Assistant Examiner* — Son M Tang
(74) *Attorney, Agent, or Firm* — Kacvinsky Daisak Bluni PLLC

(57) ABSTRACT

An open fuse block is provided having a visual indicator or light assembly connected in parallel with a replaceable fuse mounted in the fuse block. When the fuse is blown, the corresponding visual indicator is illuminated to identify the blown fuse, thereby facilitating quick and easy replacement of the fuse. Since the visual indicator is connected in parallel with the fuse element, when the fuse is blown, the fuse results in an open circuit and the flow of electricity is rerouted through the visual indicator. The visual indicator is thereby illuminated and the corresponding blown fuse can be easily identified. The visual indicator or light assembly can include, for example, a neon bulb, light emitting diode, fluorescent bulb, incandescent bulb, or any other visual indicator that emits light.

15 Claims, 4 Drawing Sheets

INTEGRATED FUSE STATUS INDICATION IN AN OPEN FUSE BLOCK

BACKGROUND

1. Field of the Invention

The disclosure generally relates to an apparatus for indicating that a fuse has opened. More particularly, the present disclosure relates to an open fuse block having an indicator, such as a light, to identify when a fuse is blown or missing.

2. Discussion of Related Art

Fuses are employed in a variety of electrical systems on an everyday basis. For example, fuses are part of electrical systems found in automobiles, boats, motorcycles and other vehicles. These fuses function to stop electricity from flowing to particular components of a system by creating an open circuit as a result of an unsafe electrical condition. However, these fuses have definite life spans, and after a period of time they blow, or burn out, leaving an open circuit which interrupts the flow of electricity to an appliance or a component of a system. In order to reinstate the flow of electricity, the blown fuse must be located and replaced with another working fuse.

Often, one or more replaceable fuses are provided in a fuse block. When the fuse burns out, the fuse is removed from the fuse block and another fuse is inserted in its place. Often, a chart, or map, is supplied which lists the electrical components corresponding to the various fuses. Accordingly, to locate a blown fuse, one must search the chart for the component that is not working, and then match the chart to the fuse block containing the blown fuse. Alternatively, a multimeter may be used to determine which of the fuses in the block has been blown or is otherwise not functioning. Of course, the difficulties inherent in such a system are even more pronounced when one attempts to replace a blown fuse in the dark or without adequate lighting. Accordingly, there is a need for a visual indicator that identifies the location of a blown fuse. Such a visual indicator should be provided on the fuse block so that it is reusable upon replacement of a blown fuse with a replacement fuse.

SUMMARY

An open fuse block is disclosed having a visual indicator or light assembly connected in parallel with a replaceable fuse mounted in the fuse block. When the fuse is blown, the corresponding visual indicator is illuminated to identify the blown fuse, thereby facilitating quick and easy replacement. Since the visual indicator is connected in parallel with the fuse element, when the fuse is blown, the fuse results in an open circuit and the flow of electricity is rerouted through the visual indicator. The visual indicator is thereby illuminated and the corresponding blown fuse can be easily identified. The visual indicator or light assembly can include, for example, a neon bulb, light emitting diode, fluorescent bulb, incandescent bulb, or any other visual indicator that emits light.

The fuse block includes a receptacle for retaining a fuse therein, a plurality of clip contacts disposed on an interior of the fuse receptacle to electrically connect to the fuse positioned within the fuse receptacle, and a visual indicator interconnected with one or more of the clip contacts in parallel with the fuse for indicating a blown fuse.

BRIEF DESCRIPTION OF THE DRAWINGS

Embodiments are illustrated by way of example, and not limitation, in the figures of the accompanying drawings in which like references indicate similar elements and in which.

DETAILED DESCRIPTION

Figure 1:
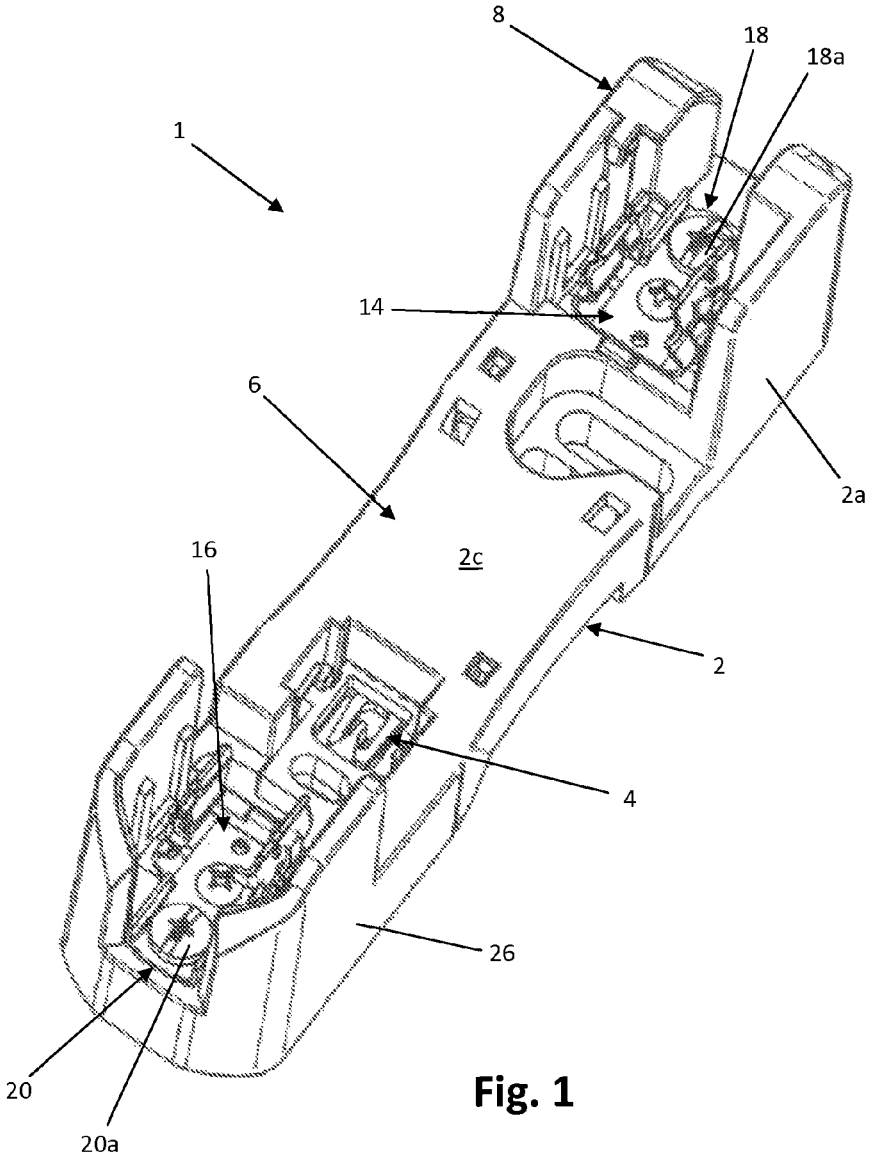
FIG. 1 is a perspective view of the disclosed open face fuse block.

FIG. 1 is a perspective view of an open-face fuse block 1 having a block portion 2 which defines an open space 4 for receiving a fuse, and a blown fuse visual indicator assembly 8. For the sake of convenience and clarity, terms such as "top," "bottom," "up," "down," "front," "rear," "vertical," "horizontal," "lateral," and "longitudinal" will be used herein to describe the relative placement and orientation of the various components of the open-face fuse block 1, all with respect to the geometry and orientation of the open-face fuse block 1 as it appears in FIG. 2. Said terminology will include the words specifically mentioned, derivatives thereof, and words of similar import.

Referring to FIG. 1, the visual indicator assembly 8 of the open-face fuse block 1 may include an LED, neon light bulb, incandescent light bulb, fluorescent light bulb, or other device capable of emitting light in response to a blown fuse. The fuse block 1 may further include a plurality of cavities that extend partially or entirely from a top surface to a bottom surface of the block portion 2. These cavities may be used to facilitate placement of the visual indicator near a top surface of the fuse block 1 so as to be easily viewed by a user. These cavities may also be used for wire routing, resistor placement, light source placement, light pipe routing and/or placement, and/or a tie-in to a remote indication module (described below).

Figure 3:
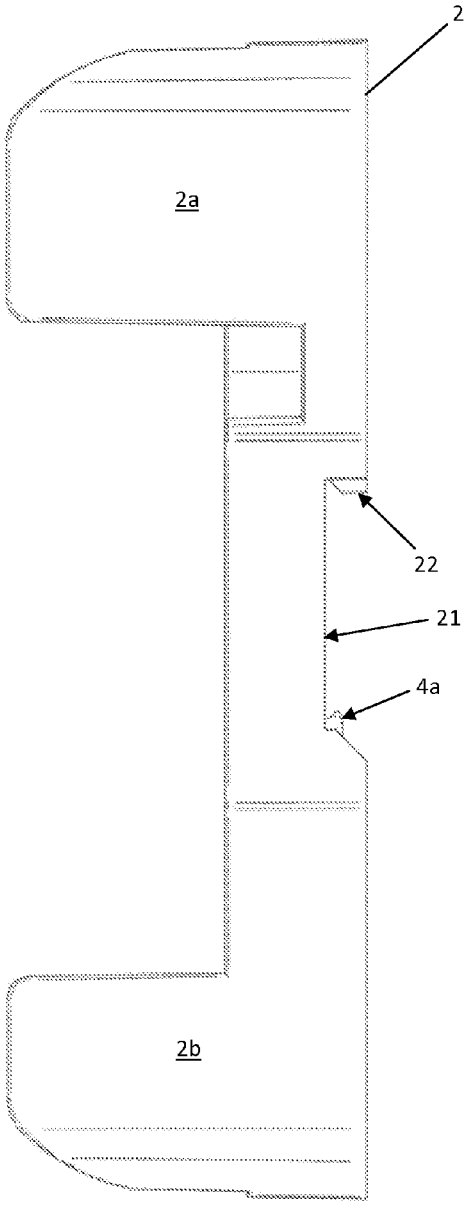
FIG. 3 is a side view of the device of FIG. 1.

The receptacle 6 is configured to receive a fuse having first and second terminals disposed at respective ends of a body of the fuse. The block portion 2 includes end portions 2*a* and 2*b* and center portion 2*c*. End portions 2*a* and 2*b* each have a pair of raised walls to accommodate the disposition of fuse clip contacts 14 and 16 (described below), respectively. The raised walls are biased inward or toward each other to provide retention forces against respective end caps of the fuse disposed there between. Center portion 2*c* includes a locking assembly 4 as described in more detail below with reference to FIG. 3.

The first and second fuse clip contacts 14 and 16 are attached to the block portion 2 and provide an electrical connection to the terminals of the fuse in the receptacle 6 (described in greater detail below). The fuse clip contacts 14 and 16 include device connection portions 18 and 20 used to couple the fuse to an electrical system to be protected, usually between a source of power and a system component. The device connection portion 18 may comprise a fastener 18*a* and a conductive plate 18*b* (shown more clearly in FIG. 2) integrally formed with the first fuse clip contact 14. Similarly, the device connection portion 20 may comprise a fastener 20*a* and a conductive plate 20*b* integrally formed with the second fuse clip contact 16.

Figure 1A:
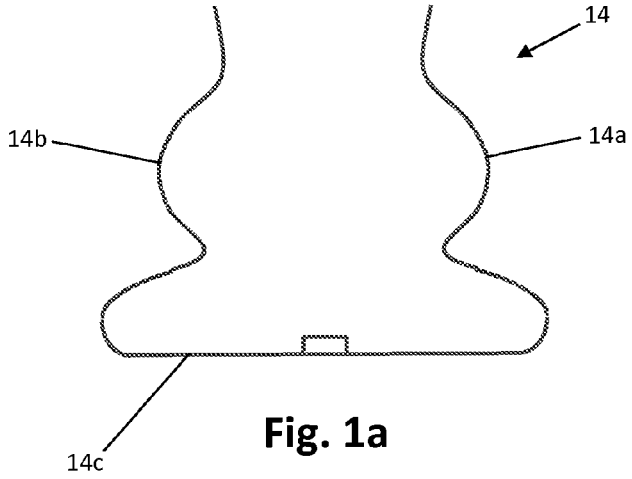
FIG. 1A is a cross sectional view of an exemplary fuse clip contact.

The fuse clip contacts 14 and 16 are substantially identical and will therefore be described with reference to the fuse clip contact 14 only. It will be understood that such description shall extend to the other fuse clip contact 16 with necessary consideration given to differences in its respective position and orientation. FIG. 1*a* is a side view of the fuse clip contact 14 comprising a first leg 14*a* and a second leg 14*b*, both of which extend from base portion 14*c*. The shape of the legs 14*a* and 14*b* is configured to bias the clip contact 14 inward, against a respective fuse end cap, and may have a geometry to partially surround and thereby retain the fuse end cap within the clip contact 14. A spring may be partially disposed around one or more of the legs 14*a*, 14*b*, and/or the base portion 14*c* to provide the fuse clip contact 14 with additional inward bias. It is further contemplated that the block end portions 2*a* and 2*b* may include protrusions which act as stops to mitigate the outward deflection of the legs 14*a* and 14*b* when a fuse end cap is disposed within the clip contact 14.

Figure 2:
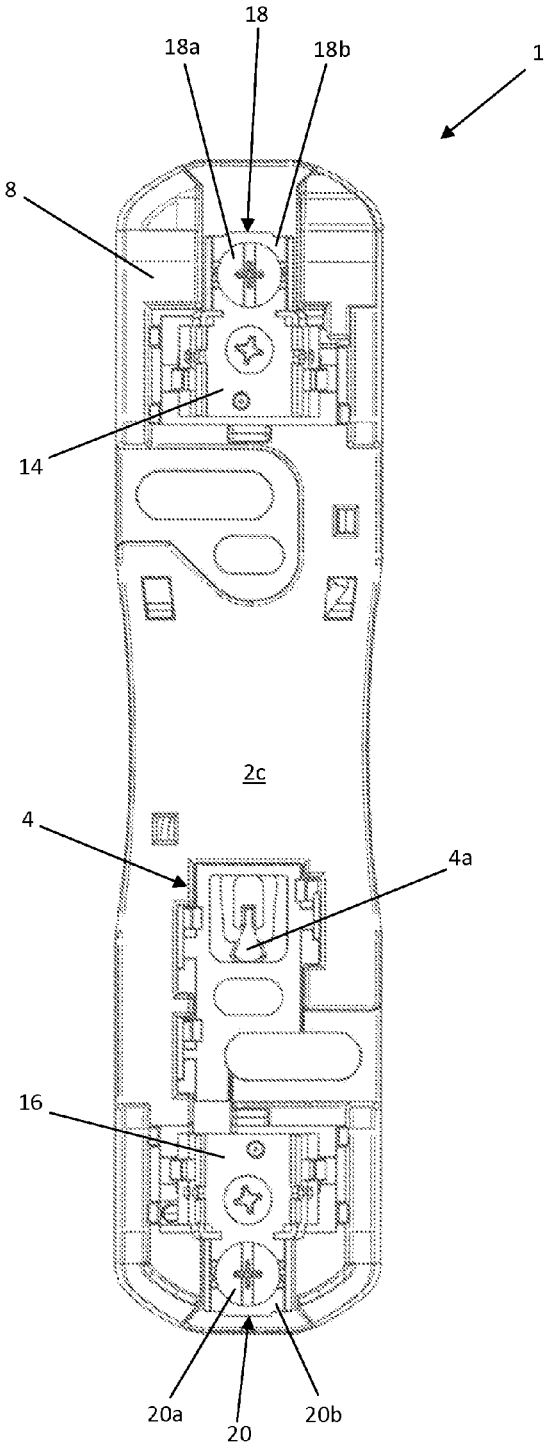
FIG. 2 is a top view of the device of FIG. 1.

FIG. 2 is a top plan view of the open-face fuse block 1 including the first fuse clip contact 14, the second fuse clip contact 16, and the visual indicator assembly 8. The visual indicator assembly 8 is electrically connected, via conductive wire or other means, to the fuse clip contacts 14 and 16. The device connection portions 18 and 20 receive wires or other electrical conductive elements coupled to a source of power and a system component respectively. When a fuse is disposed within receptacle 6, the biased clip contacts 14 and 16 complete a circuit formed between the device connection portions 18 and 20 and the fusible link (not shown) within the fuse. Thus, an electrical circuit, defined between the fuse end caps, the clip contacts 14 and 16, and the visual indicator 8, is formed when a fuse is disposed within the receptacle 6. During an overcurrent condition, a fusible element within the fuse melts creating an open circuit which prevents current flow to the protected system component while directing current to flow to the visual indicator assembly 8. In addition, when a fuse is not disposed within the receptacle 6, current also flows to the visual indicator assembly 8. Thus, the visual indicator illuminates when a fuse is installed in the receptacle and in an open condition as well as when no fuse is installed in the receptacle 6.

The center portion 2*c* of the block portion 2 includes a locking assembly 4 having a locking tab 4*a* that extends longitudinally along the length of the block 2 to lock the open-face fuse block 1 on a conventional DIN rail. Particularly, referring to the DIN rail mounting feature illustrated in the side view of block portion 2 in FIG. 3, the center portion 2*c* of block portion 2 includes cut-out portion 21. This cut-out portion 21 is used to attach the open-face fuse block 1 to a DIN rail. The upper portion of the cut-out portion 21 includes a protrusion 22 which attaches to the DIN rail and, as noted above, the locking tab 4*a* is used to lock the block portion 2 to the rail.

Figure 4:
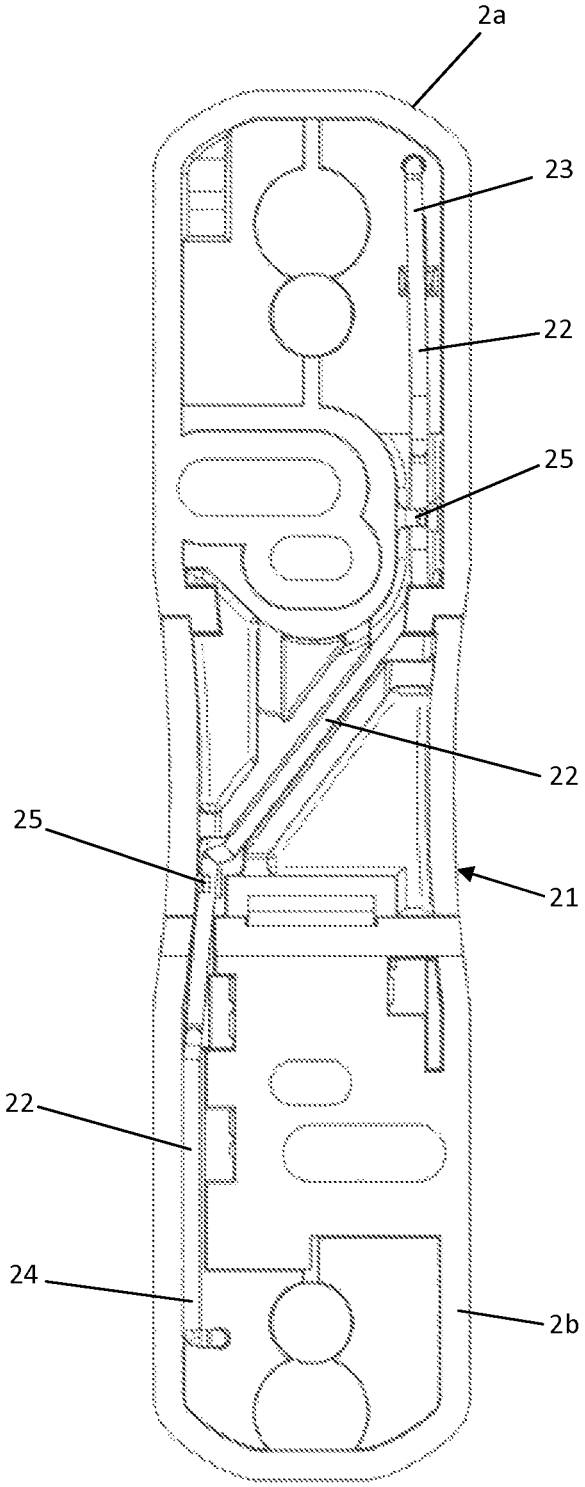
FIG. 4 is a bottom view of the device of FIG. 1.

FIG. 4 is a bottom plan view of open-face fuse block 1 illustrating an exemplary embodiment of wire routing between the clip contacts 14 and 16 to supply current to the visual indicator assembly 8 when a fuse is disposed within the receptacle 6 and the fusible link is opened (clip contacts 14 and 16, indictor assembly 8, and receptacle 6 are not within view in FIG. 4). Particularly, an electrically conductive wire 22 is routed along the bottom side of the block portion 2 and extends between the fuse clip contacts 14 and 16. The wire 22 may be retained on the bottom side of the block portion 2 using retention clips 25 as shown in FIG. 4, and can additionally or alternatively be disposed within a channel molded into the bottom side of block portion 2. The wire 22 may further be protected from tampering or accidental damage by raising or recessing such a channel within the bottom side of the block portion 2.

A first end 23 of the wire 22 extends through an aperture in the underside of the fuse block end portion 2*a* and is connected to the clip contact 14. For example, the first end 23 can be attached to the leg 14*a* (see FIG. 1*a*) of the clip contact 14. An electrical connection is thereby formed with visual indicator assembly 8, which is electrically connected to the leg 14*b*, via the connection of the wire end 23 with the leg 14*b* via the leg 14*a* and base portion 14*c*. Similarly, the second end 24 of the wire 22 extends through an aperture in the underside of the fuse block end portion 2*b* and is connected to a leg of the clip contact 16. Many other methods and configurations for providing an electrical connection between the clip contacts 14 and 16 are contemplated but will not be described in detail herein as they are well known in the art.

A variety of attachment methods are contemplated for attaching the fuse clip contacts 14 and 16 to a power source and to a component to be protected. For example, a mechanical connection may be provided such that the fuse clip contacts 14 and 16 tighten down onto the wire in a conventional manner. In particular, a fastener such as, for example, screws 18*a* and 20*a* may be used to retain the respective ends 23 and 24 of the wire 22 in contact with the terminals of the device connection portions 18 and 20. Alternatively, a mechanical connection may be provided in which the wire 22 is inserted into a push-in style female feature on the clip contacts 14 and 16 in a manner that will be familiar to those of ordinary skill in the art. Alternatively, the wire 22 may be soldered to form the connections.

Many alternative electrical connection methods are contemplated for connecting the wire 22 to the fuse disposed within the receptacle 6. For example, the wire 22 may be attached to a spring mechanism that would contact the ends of the fuse when a fuse is inserted into the fuse clip contacts 14 and 16. This would electrically connect the indicator assembly 8 in parallel to the fuse. In this manner, visual indicator 8 would only receive current when a fuse is installed within the receptacle 6 and is open, and no current would pass through the indicator assembly 8 when a fuse is not installed in the receptacle 6. Thus, an electrical circuit, defined between a fuse's end caps, the clip contacts 14 and 16, and the visual indicator 8, is only formed when a fuse is disposed within the receptacle 6.

In normal operation of an electrical system, current flows from an electrical source, through the fuse block 1, through the fuse element in the receptacle 6, and to an electrical component. If the fuse blows, the flow of electricity is re-routed to flow from the electrical source to the visual indicator of visual indicator assembly 8, and then to a load side, to illuminate an LED, neon bulb, etc., to identify that the fuse has been blown. Upon replacement of the blown fuse with a working fuse, electricity is re-routed back to flow through the fuse, at which time the LED, neon bulb, etc., of visual indicator assembly 8 returns to being dormant.

Figure 5A:
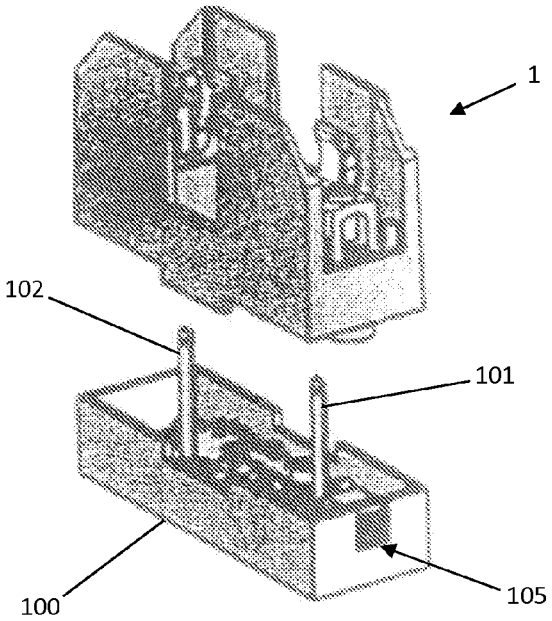
FIGS. 5A-5D illustrate an alternative embodiment of the present disclosure including an open-face fuse block and a stackable add-on for remote indication of a blown fuse.

FIGS. 5A-5D illustrate an alternative embodiment of the present disclosure. In particular, FIG. 5A is a perspective view of the fuse block 1 and a stackable block 100 used for housing electronics associated with remote indication of a blown fuse in the fuse block 1. Stackable block 100 includes first and second male blades 101 and 102 that extend through the bottom of the fuse block 1 and engage the clip contacts 14 and 16, respectively. The stackable block 100 may have a similar shape to the fuse block 1 in order for the operative combination of the stackable block 100 and the open-face fuse block 1 to have the same footprint as the fuse block 1 when installed. The stackable block 100 may also include a receptacle assembly 105 to accommodate connections to circuitry as described below. Electrical connection of the circuitry of block 100 to fuse block 1 may be achieved using a variety of other conventional connection methods such as, for example, by one or more electrically conductive wires extending there between.

Figure 5B:
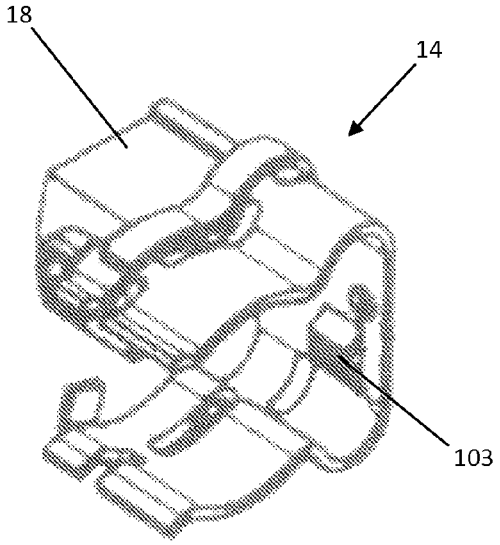

FIG. 5B illustrates a perspective view of the exemplary clip contact 14 (representative of both of the substantially similar clip contacts 14 and 16) and the device connection portion 18. The clip contact 14 includes a female feature 103 that is configured to receive one of the male blades 101 or 102 from the stackable block 100. The female feature 103 can be any structure adapted to receive the male blades 101 or 102 there through, such as an aperture with or without a cuff or a sleeve extending from a periphery thereof. When operatively mounted in the female features 103, the male blades 101 and 102 are electrically connected to respective clip contacts 14 and 16, thereby facilitating monitoring of the voltage across the terminals of the fuse disposed between the clip contacts 14 and 16.

Figure 5C:
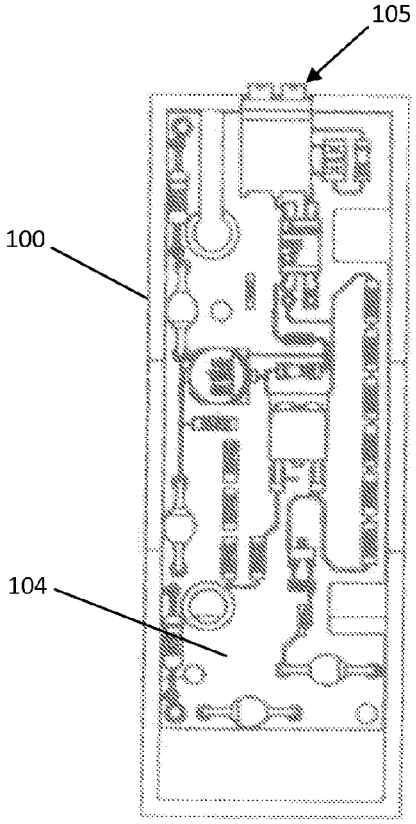

FIG. 5C is a bottom view of the stackable block 100 housing a printed circuit board (PCB) 104 and associated circuitry. The circuitry on PCB 104 may be used to communicate the occurrence of an open fuse to a remote location as well as communicating normal operation of the fuse in the absence of an open fuse occurrence. It is contemplated that the circuitry can communicate the status of the fuse to the remote location through hardwired connection or through wireless connection, such as via radio or infrared signal, or via WiFi or Bluetooth connection. Such communication can be implemented in addition to, or in place of, the above-described visual indication facilitated by the visual indicator assembly 8 of the open-face fuse block 1.

Figure 5D:
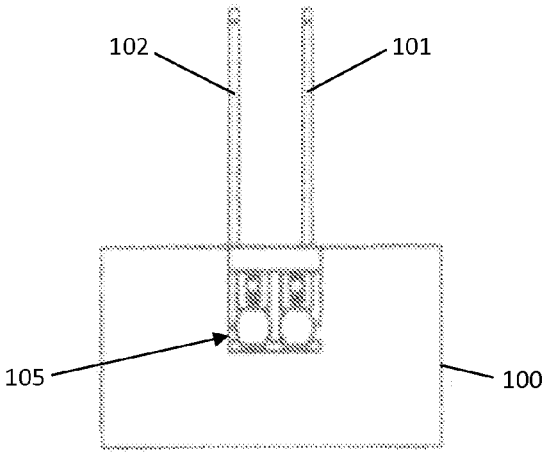

FIG. 5D is an end-on view of the stackable block 100 and receptacle assembly 105. It will be noted that the male blades 101 and 102 are laterally misaligned (or staggered) along the length of the stackable block 100. This configuration facilitates the use of a single variety of clip contact, such as the clip contact 14 shown in FIG. 5B, for both of the clip contacts 14 and 16 such that only one type of clip contact needs to be manufactured. In particular, the clip contact 14 shown in FIG. 5B is illustrated with the device connection 18 toward the left portion thereof and female feature 103 toward the lower portion thereof. To use an identical type of clip contact for the clip contact 16 (i.e. identical to clip contact 14), the clip contact 16 must be rotated 180 degrees about a vertical axis (in reference to FIG. 5D) relative to the clip contact 14, thereby positioning the device connection 20 of the clip contact 16 toward the right side thereof and the female feature 103 of the clip contact 16 toward the upper portion thereof (relative to clip contact 14).

Thus, identical clip contacts with identically located female features 103 and device connections 18 and 20 can be used for each of the clip contacts 14 and 16 to receive the male blades 101 and 102, thereby reducing the cost of manufacturing clip contacts 14 and 16 relative to manufacturing two different types clip contacts. This necessitates the above-described misaligned or laterally-staggered configuration of the male blades 101 and 102 to facilitate proper alignment and mating engagement with their respective female features 103 and the above-described electrical to allow remote monitoring of the voltage across the clip contacts 14 and 16 of fuse block 1. It will be noted that if the male blade 101 and 102 were not laterally-staggered, and were instead longitudinally aligned with one another, two different clip contacts would have to be manufactured to accommodate the blades 101 and 102, wherein the clip contacts would be mirror images of one another across a vertical plane located intermediate the clip contacts 14 and 16. Although not preferred, it is contemplated that such a configuration can be implemented without departing from the present disclosure.

Of course, it will be appreciated that the above-described circuitry of the stackable block 100 can be integrated directly into the fuse block 1 and that remote communication of the status of a fuse mounted within the fuse block 1 can thereby be effectuated without the addition of the stackable block 100.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. A fuse block comprising:

a fuse receptacle for receiving a fuse therein;

a plurality of clip contacts disposed on an interior of the fuse receptacle to electrically communicate with a fuse positioned within the fuse receptacle, at least two of the plurality of clip contacts electrically connected to one another by an electrically conductive wire, the electrically conductive wire disposed within a channel extending along a bottom side of the fuse block; and an indicator interconnected with one or more of the clip contacts for indicating a blown fuse;

wherein the indicator is electrically connected to the clip contacts in parallel with the fuse and receives current from the electrically conductive wire.

2. The fuse block of claim 1, wherein the indicator is a visual indicator.

3. The fuse block of claim 2, wherein the visual indicator is selected from one of a group of visual indicators consisting of a light emitting diode, a neon light bulb, an incandescent light bulb, and a fluorescent light bulb.

4. The fuse block of claim 1, further comprising a locking assembly for locking the fuse block to a DIN rail.

5. The fuse block of claim 1, further comprising device connection portions electrically connected to the clip contacts for electrically connecting the fuse to a power source and a system component to which power is delivered.

6. The fuse block of claim 1, wherein at least one of the clip contacts comprises a substantially planar base portion and two legs extending from opposing ends of the base portion and biased toward one another for firmly gripping an end cap of the fuse there between.

7. The fuse block of claim 1, wherein said plurality of clip contacts comprises a first clip contact located adjacent to a first end of the fuse block and a second clip contact located adjacent to a second end of the fuse block.

8. The fuse block of claim 7, wherein the first and second clip contacts are electrically connected to one another by the electrically conductive wire.

9. The fuse block of claim 1, further comprising circuitry mounted within a housing for determining a status of the fuse and communicating such status to a remote location.

10. The fuse block of claim 9, wherein the circuitry communicates the status of the fuse to a remote location through a wired connection.

11. The fuse block of claim 9, wherein the circuitry communicates the status of the fuse to a remote location through a wireless connection.

12. The fuse block of claim 1, further comprising a stackable block mounted to the fuse block in a stacked configuration and facilitating communication of the status of the fuse to a remote location, the stackable block comprising:

a housing;

circuitry mounted within the housing for determining a status of the fuse and communicating such status to a remote location; and conductive elements extending from the circuitry to the clip contacts in the fuse block for communicating a voltage across the fuse to the circuitry.

13. The stackable block of claim 12, wherein the conductive elements comprise elongated male blades that extend through corresponding female elements in the clip contacts of the fuse block.

14. The stackable block of claim 12, wherein the circuitry communicates the status of the fuse to a remote location through a wired connection.

15. The stackable block of claim 12, wherein the circuitry communicates the status of the fuse to a remote location through a wireless connection.

* * * * *